US006843758B2

(12) United States Patent
Qiu

(10) Patent No.: US 6,843,758 B2
(45) Date of Patent: Jan. 18, 2005

(54) DAMPING DEVICE FOR AN EXERCISING CYCLE

(76) Inventor: Rui-Zung Qiu, 159, Bao Jie St., Jia Yi City (TW)

( * ) Notice: Subject to any disclaimer, the term of this patent is extended or adjusted under 35 U.S.C. 154(b) by 6 days.

(21) Appl. No.: 10/307,720

(22) Filed: Dec. 2, 2002

(65) Prior Publication Data

US 2004/0106505 A1 Jun. 3, 2004

(51) Int. Cl.[7] ..... A63B 69/16
(52) U.S. Cl. ..... 482/61; 482/60
(58) Field of Search ..... 482/51, 57, 58, 482/60, 61, 63

(56) References Cited

U.S. PATENT DOCUMENTS 5,656,001 A * 8/1997 Baatz ..... 482/61
5,792,030 A * 8/1998 Sartore ..... 482/61
5,944,637 A * 8/1999 Stickler et al. ..... 482/61
6,361,477 B1 * 3/2002 Kolda ..... 482/61

OTHER PUBLICATIONS

Schroeder, US 2001/Pub. No. 0041648.*
Kolda et al., US 2003/0158016 A1.*

* cited by examiner

*Primary Examiner*—Nicholas D. Lucchesi
*Assistant Examiner*—Tam Nguyen
(74) *Attorney, Agent, or Firm*—Alan D. Kamrath; Nickolai & Mersereau, P.A.

(57) ABSTRACT

A damping device for an exercising cycle includes a support base, and a damping unit. The damping unit includes a contact wheel rotatably mounted on the support base, a flywheel mounted on the first end of the shaft of the contact wheel, and a stirring wheel mounted on the second end of the shaft of the contact wheel and mounted in a container which contains hydraulic oil therein. Thus, the contact wheel is rotated by the rear wheel to rotate the shaft which rotates the flywheel, so that the blades of the flywheel are rotated to produce an air flow which is used to cool the heat produced by the friction between the contact wheel and the rear wheel, and to cool the hydraulic oil contained in the container.

7 Claims, 8 Drawing Sheets

DAMPING DEVICE FOR AN EXERCISING CYCLE

BACKGROUND OF THE INVENTION

1. Field of the Invention

The present invention relates to a damping device for an exercising cycle, and more particularly to a damping device for an exercising cycle, wherein the resistance of the contact wheel applied on the rear wheel is adjusted by rotating the threaded rod, so as to fit the user's requirement.

2. Description of the Related Art

Sometimes, the exercise activities of the people are restricted and performed indoors because of heavily congested urban areas, crowded traffic or bad weather. Therefore, it is necessary to provide a body exercising machine which can be used indoors. However, a conventional body exercising machine such as the tread machine, the exercising bicycle or the like occupies a lot of space and cannot be adjusted easily, thereby causing a great waste of space, and thereby causing inconvenience in storage and transportation.

SUMMARY OF THE INVENTION

The present invention has arisen to mitigate and/or obviate the disadvantage of the conventional damping device for an exercising cycle.

The primary objective of the present invention is to provide a damping device for an exercising cycle, wherein the resistance of the contact wheel applied on the rear wheel is adjusted by rotating the threaded rod, so as to fit the user's requirement.

Another objective of the present invention is to provide a damping device for an exercising cycle, wherein the contact wheel is rotated by the rear wheel to rotate the shaft which rotates the flywheel, so that the blades of the flywheel are rotated to produce an air flow which is used to cool the heat produced by the friction between the contact wheel and the rear wheel, and to cool the hydraulic oil contained in the container.

A further objective of the present invention is to provide a damping device for an exercising cycle, wherein the contact wheel is rotated by the rear wheel to rotate the shaft which rotates the stirring wheel, so that the blades of the stirring wheel are rotated in the container to stir the hydraulic oil contained in the container, thereby increasing the damping force of the resistance of the contact wheel applied on the rear wheel.

A further objective of the present invention is to provide a damping device for an exercising cycle, wherein when not in use, the second support rack is pivoted relative to the first support rack, thereby folding the damping device of the exercising cycle, so that the folded damping device of the exercising cycle has a smaller volume, thereby facilitating storage and transportation thereof.

In accordance with the present invention, there is provided a damping device for an exercising cycle, comprising a support base, and a damping unit, wherein:

the damping unit is mounted on the support base and includes a contact wheel rotatably mounted on the support base and having a shaft, a flywheel mounted on a first end of the shaft of the contact wheel, and a stirring wheel mounted on a second end of the shaft of the contact wheel and mounted in a container which contains hydraulic oil therein.

Preferably, the damping unit includes a threaded rod extended through the retaining member and having a first end provided with a holding portion and a second end rested on a surface of the support base.

Preferably, the damping unit includes a positioning nut mounted on the threaded rod and rested on the retaining member.

Further benefits and advantages of the present invention will become apparent after a careful reading of the detailed description with appropriate reference to the accompanying drawings.

DETAILED DESCRIPTION OF THE INVENTION

Figure 1:
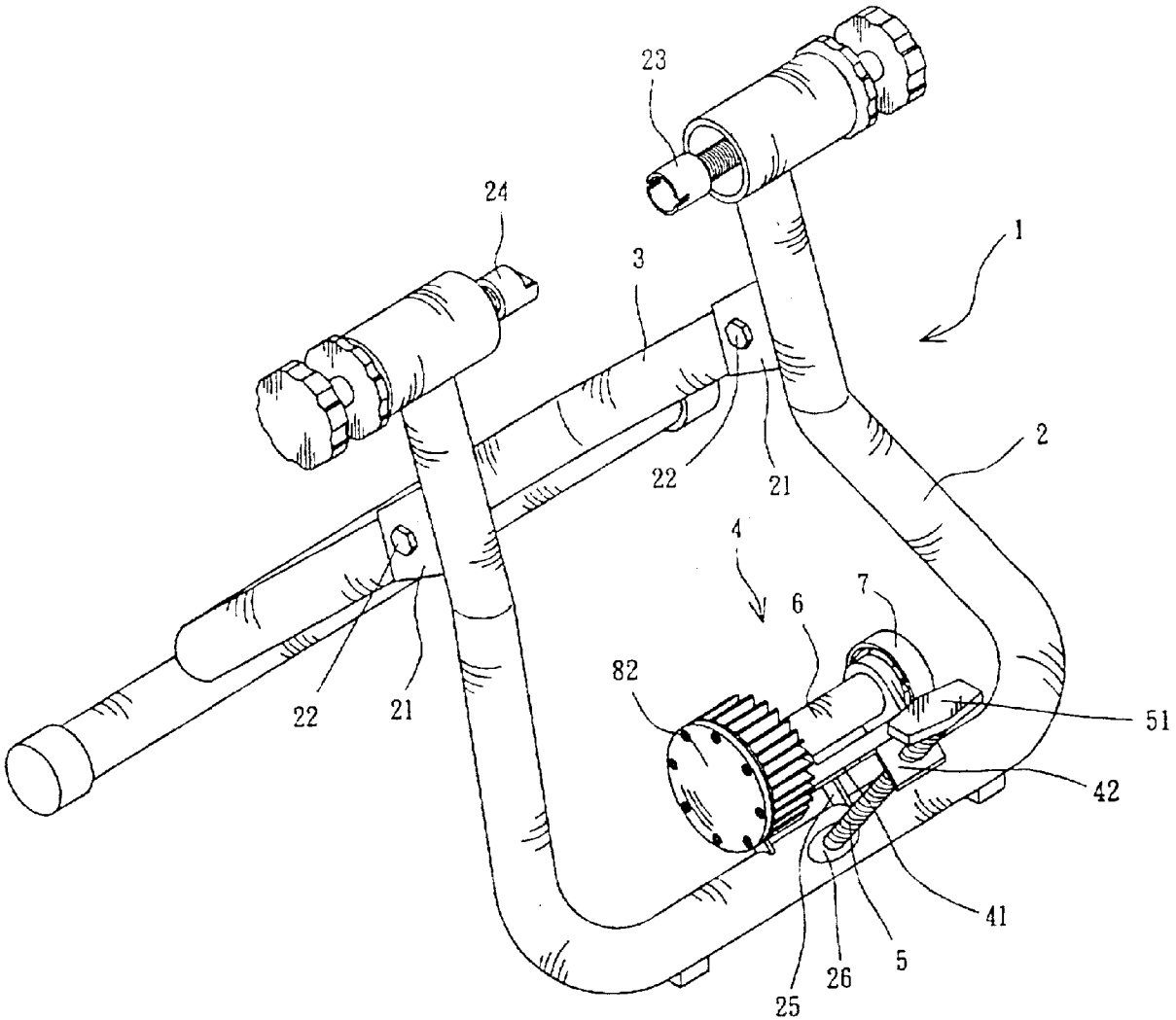
FIG. 1 is a perspective view of a damping device for an exercising cycle in accordance with a preferred embodiment of the present invention.

Referring to the drawings and initially to FIGS. 1–8, a damping device for an exercising cycle in accordance with a preferred embodiment of the present invention comprises a support base 1, and a damping unit 4.

The support base 1 includes a substantially U-shaped first support rack 2, and a substantially U-shaped second support rack 3 combined with the first support rack 2. The first support rack 2 is provided with two protruding ears 21 for mounting the second support rack 3 by two screw members 22. The first support rack 2 of the support base 1 has two distal ends formed with two support shafts 23 and 24 for mounting a rear wheel 9.

The damping unit 4 is mounted on the mediate portion of the first support rack 2 of the support base 1. The mediate portion of the first support rack 2 of the support base 1 is provided with two spaced support ears 25. The damping unit 4 includes a support member 41 pivotally mounted on the two support ears 25 of the first support rack 2, and a retaining member 42 mounted on a top end of the support member 41.

A threaded rod 5 is extended through the retaining member 42, and has a first end provided with a holding portion 51 and a second end rested on a surface of the mediate portion of the first support rack 2 of the support base 1. Preferably, the mediate portion of the first support rack 2 of the support base 1 is formed with a concave portion 26 for receiving the second end of the threaded rod 5. A positioning nut 52 is mounted on the threaded rod 5 and is rested on the retaining member 42.

Figure 3:
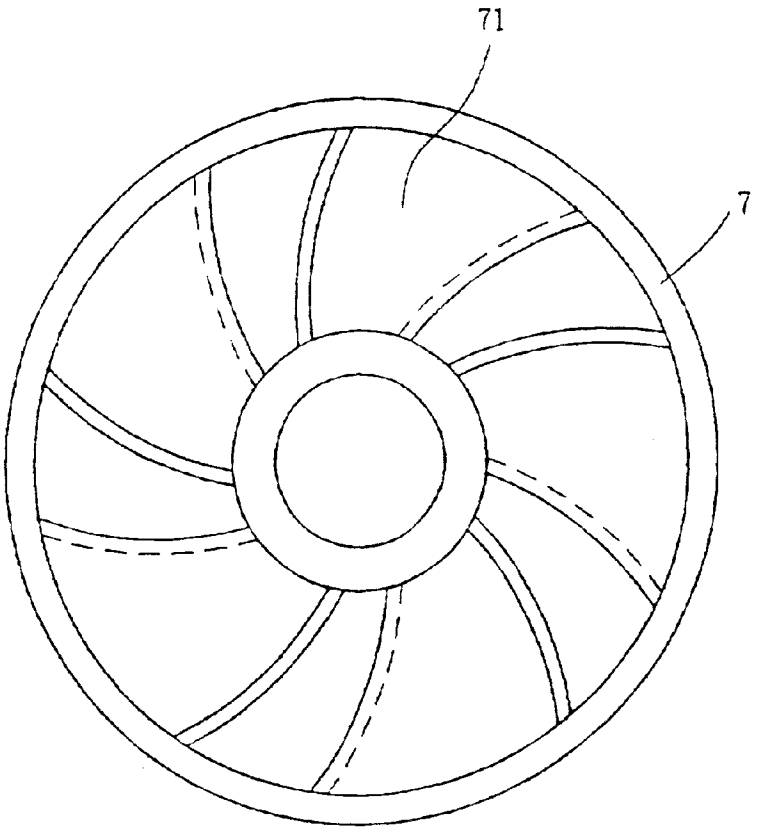
FIG. 3 is a front plan view of the flywheel of the damping device for an exercising cycle as shown in FIG. 2.
Figure 2:
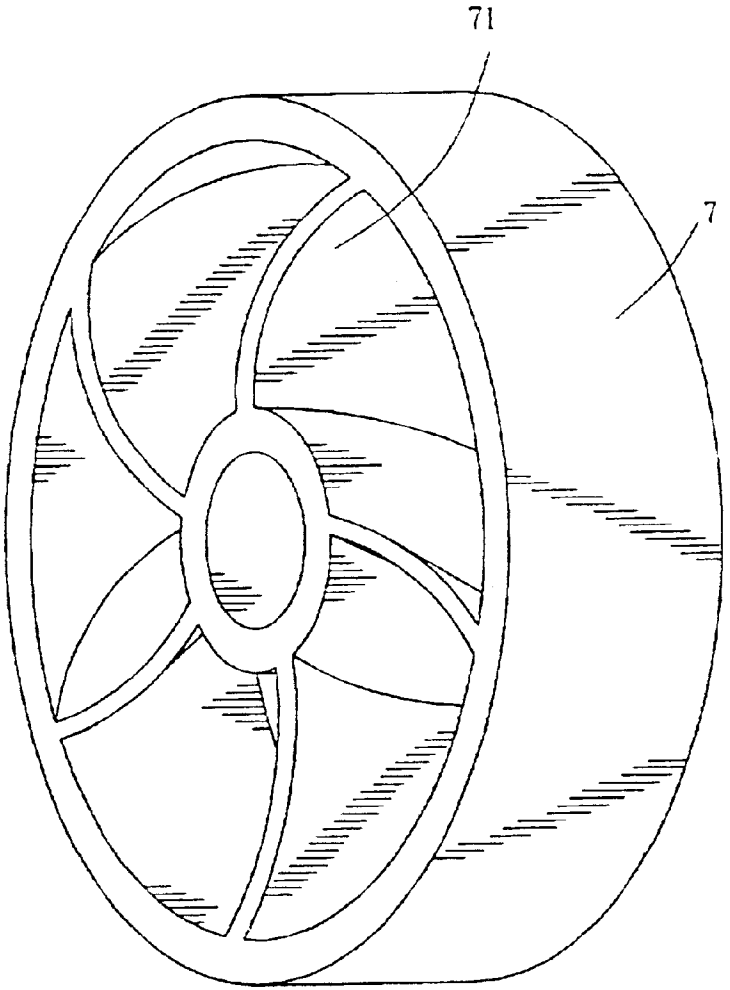
FIG. 2 is a perspective view of a flywheel of the damping device for an exercising cycle in accordance with the preferred embodiment of the present invention.
Figure 5:
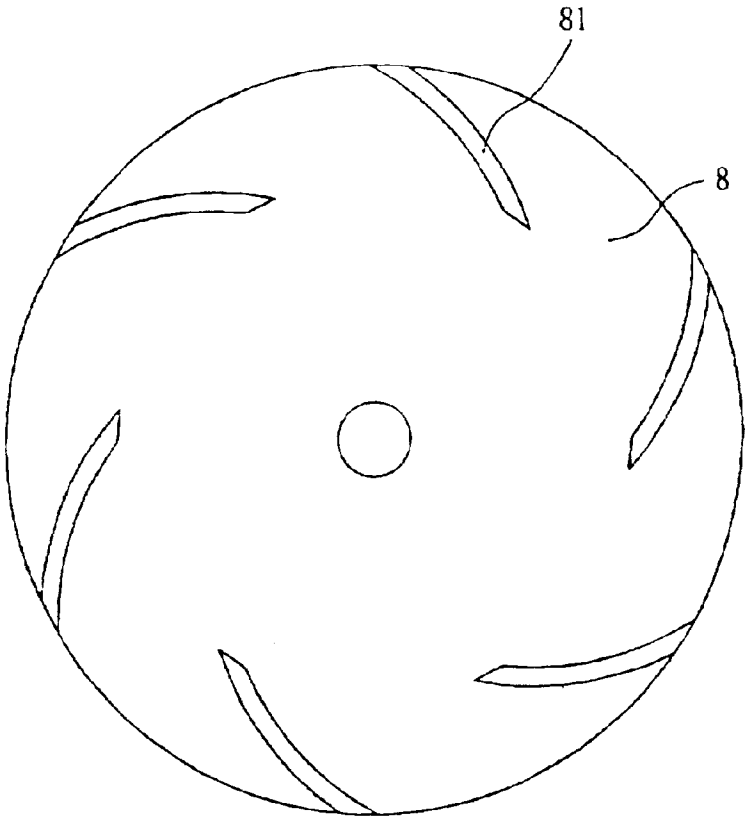
FIG. 5 is a front plan view of the stirring wheel of the damping device for an exercising cycle as shown in FIG. 4.
Figure 4:
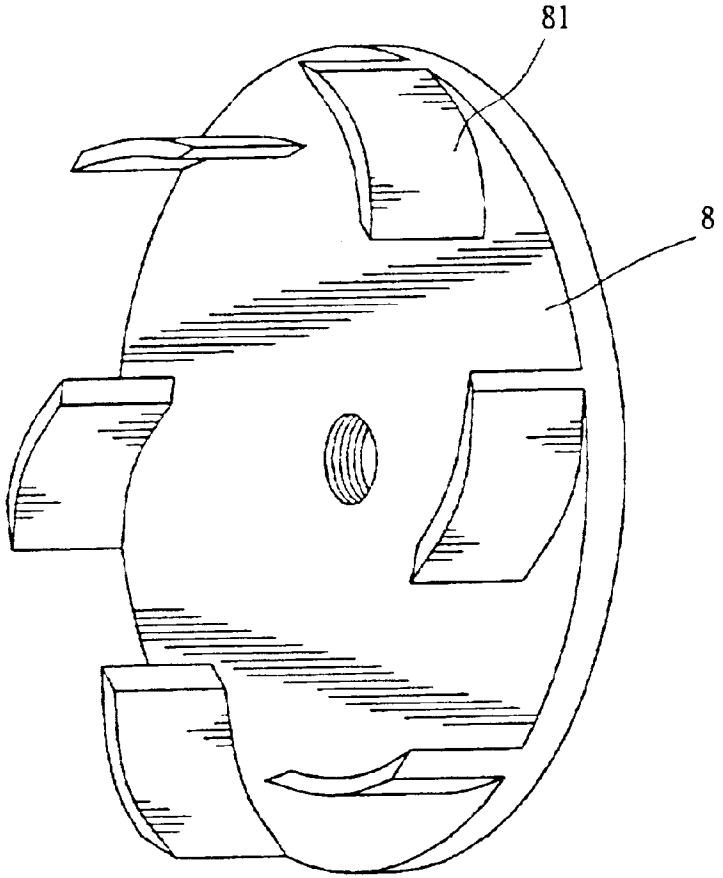
FIG. 4 is a perspective view of a stirring wheel of the damping device for an exercising cycle in accordance with the preferred embodiment of the present invention.
Figure 6:
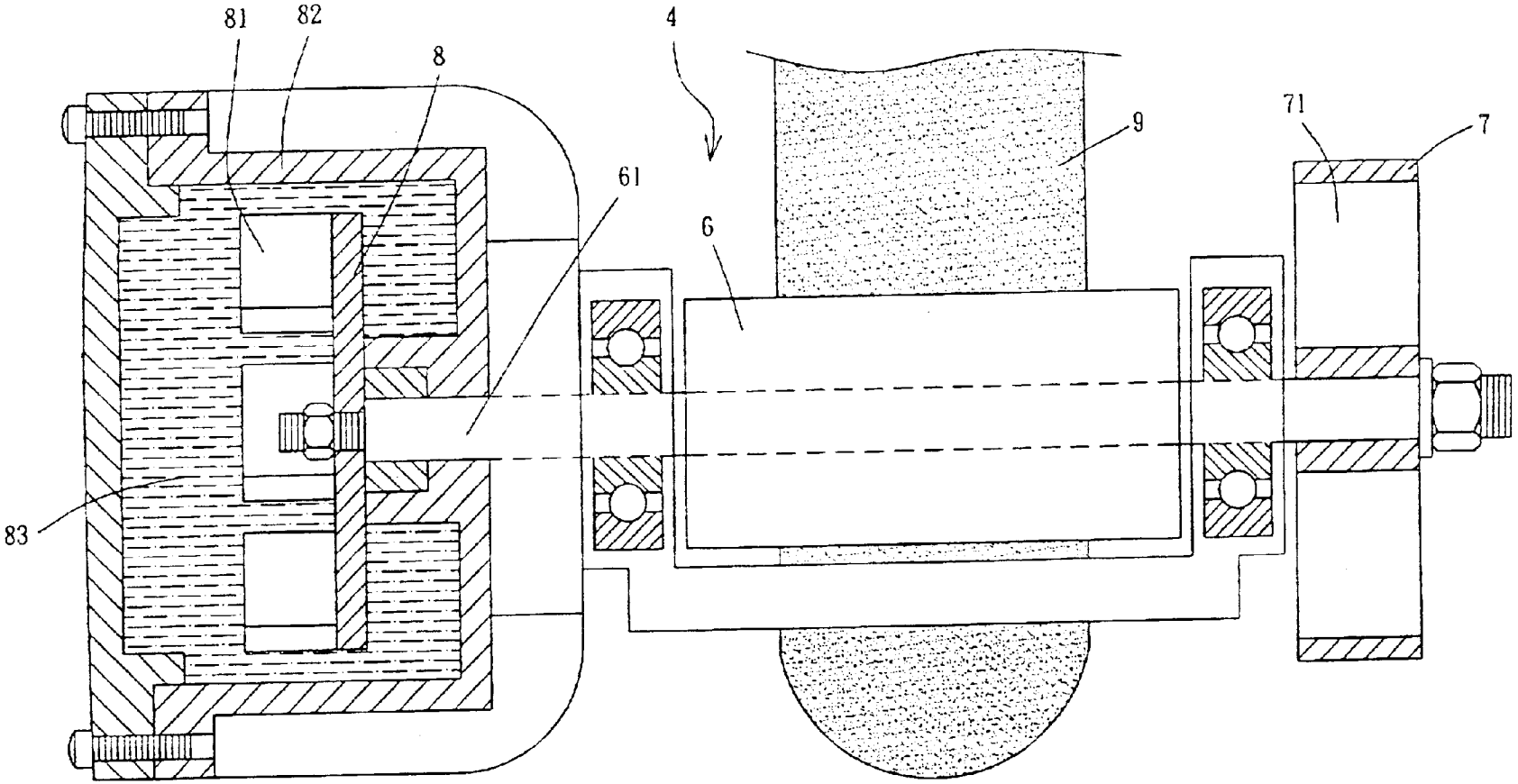
FIG. 6 is a partially cut-away plan cross-sectional assembly view of the damping device for an exercising cycle as shown in FIG. 1.

A contact wheel 6 is mounted on the support member 41, and has a shaft 61. A flywheel 7 is mounted on a first end of the shaft 61 of the contact wheel 6. The flywheel 7 includes a plurality of arcuate blades 71 as shown in FIGS. 2 and 3. A stirring wheel 8 is mounted on a second end of the shaft 61 of the contact wheel 6, and is mounted in a container 82. The stirring wheel 8 includes a plurality of arcuate blades 81 as shown in FIGS. 4 and 5. The container 82 is mounted on the mediate portion of the first support rack 2 of the support base 1, and contains hydraulic oil 83 therein.

Figure 7:
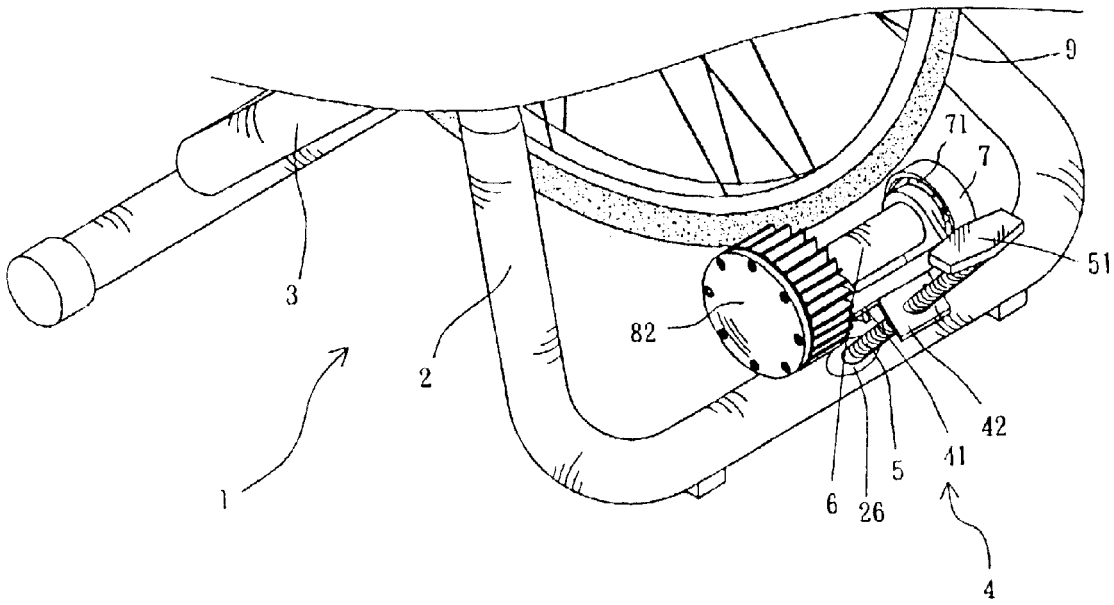
FIG. 7 is a partially cut-away perspective view showing the damping device being applied on a rear wheel of the exercising cycle.
Figure 8:
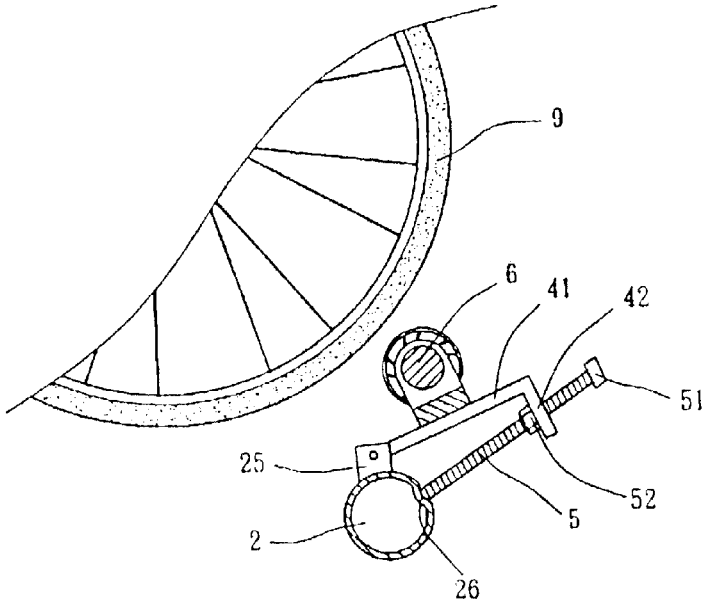
FIG. 8 is a side plan cross-sectional view of the damping device for an exercising cycle as shown in FIG. 7.
Figure 9:
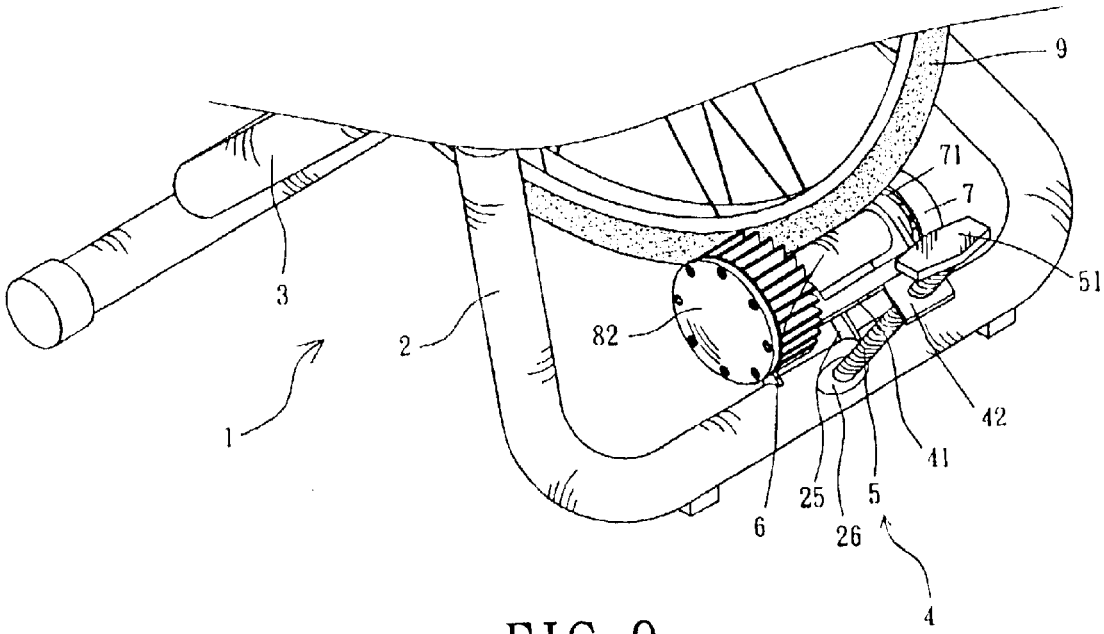
FIG. 9 is a schematic operational view of the damping device for an exercising cycle as shown in FIG. 7 in use.
Figure 11:
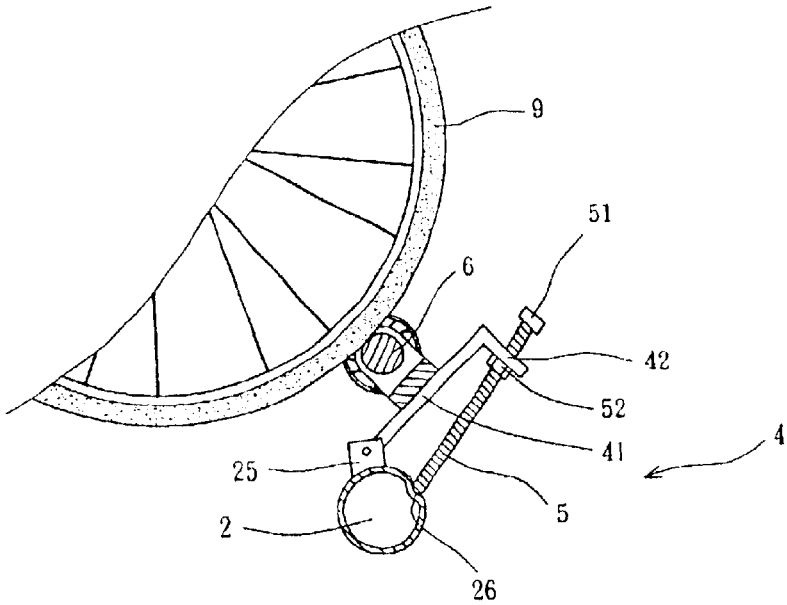
FIG. 11 is a schematic operational view of the damping device for an exercising cycle as shown in FIG. 8 in use.
Figure 10:
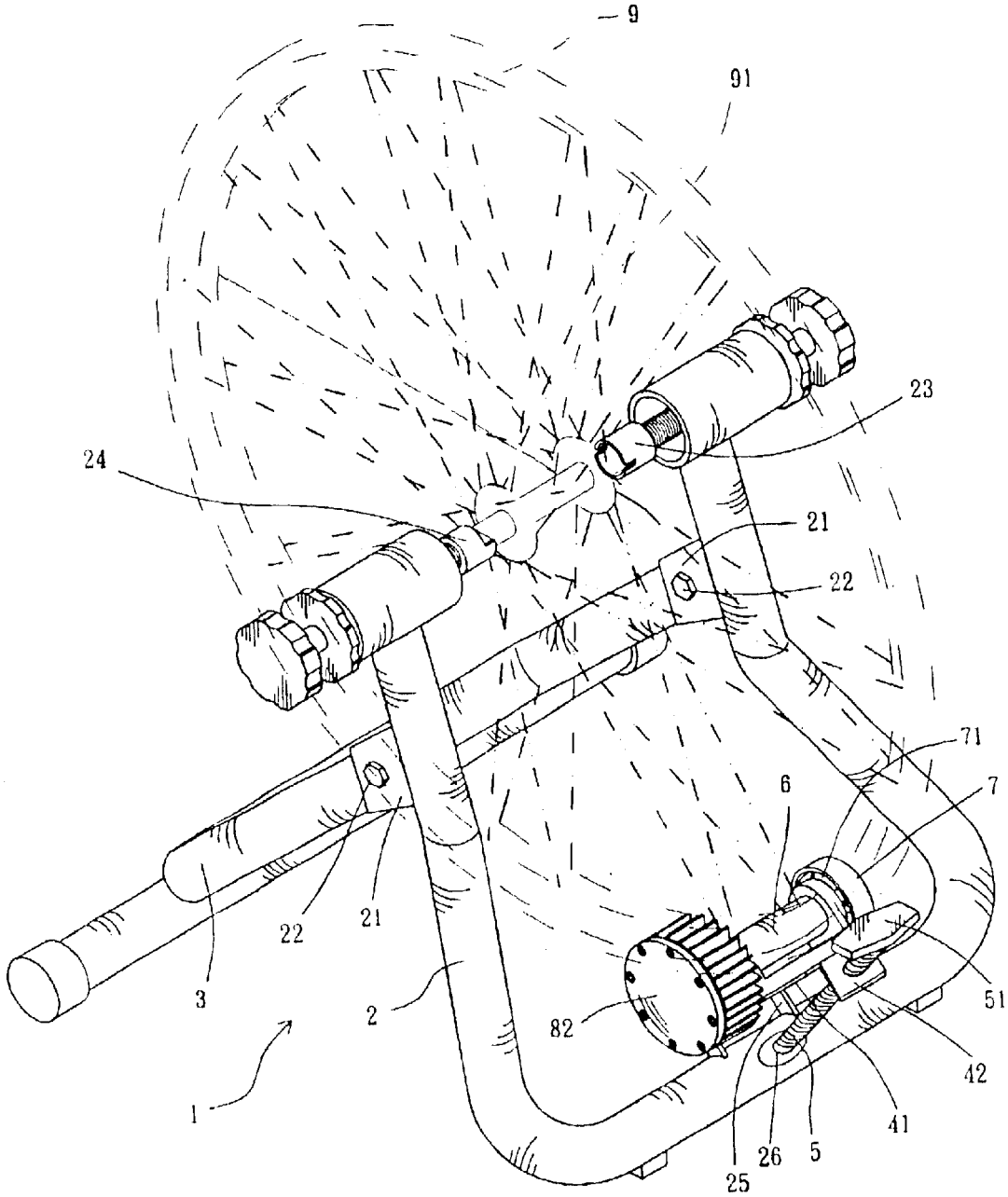
FIG. 10 is a perspective view showing the damping device being applied on the rear wheel of the exercising cycle.

In assembly, referring to FIGS. 7–11 with reference to FIGS. 1–6, the shaft 91 of the rear wheel 9 is mounted on the two support shafts 23 and 24 of the first support rack 2 of the support base 1. The contact wheel 6 is initially not in contact with the rim of the rear wheel 9 as shown in FIGS. 7 and 8. Then, the threaded rod 5 is rotated by rotating the holding portion 51, to move the retaining member 42, so that the support member 41 is pivoted on the two support ears 25 of the first support rack 2, thereby moving the contact wheel 6, so that the contact wheel 6 is moved from the position as shown in FIGS. 7 and 8 to the position as shown in FIGS. 9 and 11 so as to contact the rim of the rear wheel 9, thereby providing a resistance to rotation of the rear wheel 9.

Thus, the resistance of the contact wheel 6 applied on the rear wheel 9 is adjusted by rotating the threaded rod 5, so as to fit the user's requirement.

In addition, the contact wheel 6 is rotated by the rear wheel 9 to rotate the shaft 61 which rotates the flywheel 7, so that the blades 71 of the flywheel 7 are rotated to produce an air flow which is used to cool the heat produced by the friction between the contact wheel 6 and the rear wheel 9, and to cool the hydraulic oil 83 contained in the container 82.

At the same time, the contact wheel 6 is rotated by the rear wheel 9 to rotate the shaft 61 which rotates the stirring wheel 8, so that the blades 81 of the stirring wheel 8 are rotated in the container 82 to stir the hydraulic oil 83 contained in the container 82, thereby increasing the damping force of the resistance of the contact wheel 6 applied on the rear wheel 9.

Figure 12:
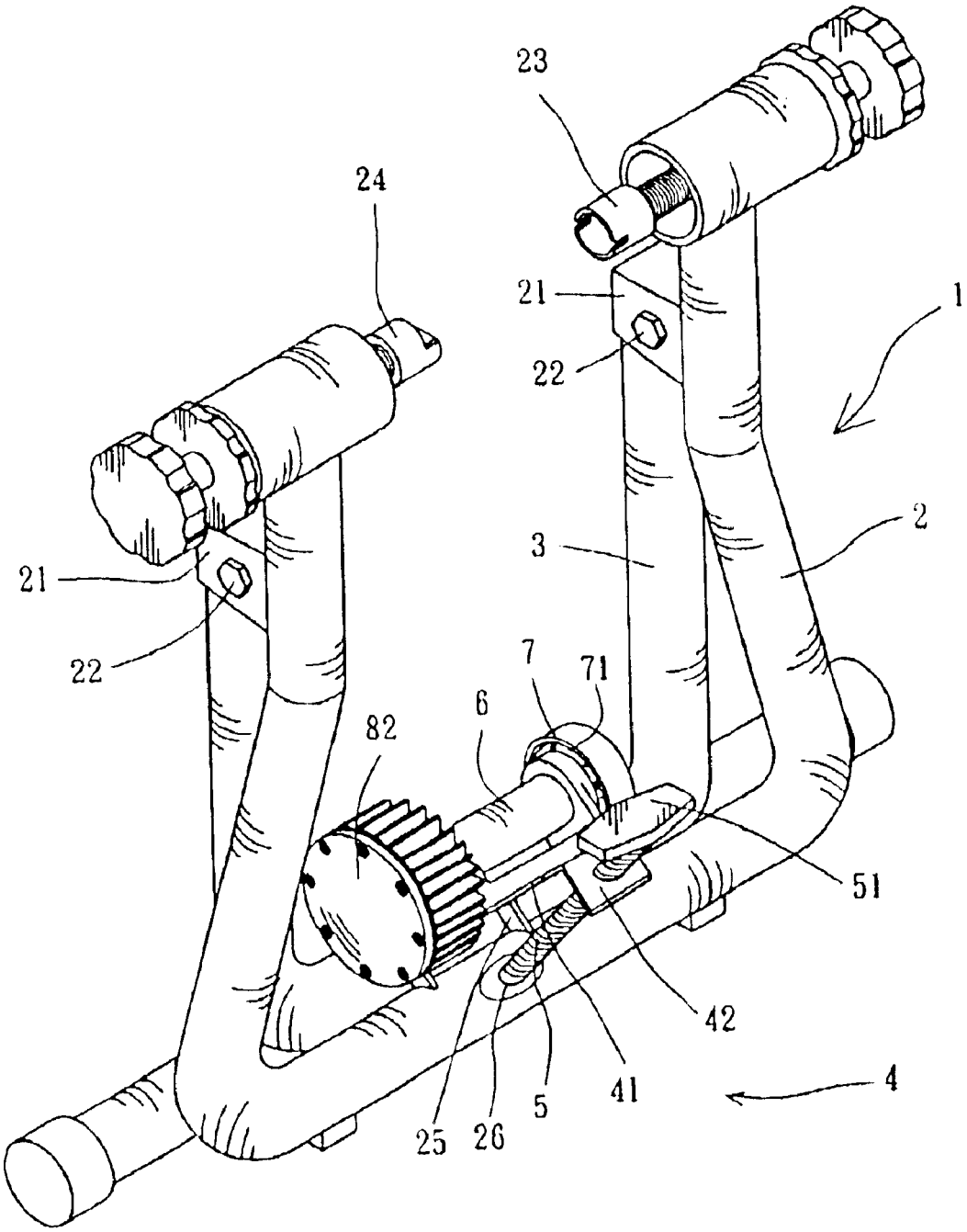
FIG. 12 is a perspective view showing the damping device being folded.

Referring to FIG. 12, when not in use, the threaded rod 5 is rotated by rotating the holding portion 51, to move the retaining member 42, so that the support member 41 is pivoted on the two support ears 25 of the first support rack 2, thereby moving the contact wheel 6, so that the contact wheel 6 is moved from the position as shown in FIGS. 9 and 11 to the position as shown in FIGS. 7 and 8, thereby detaching the contact wheel 6 from the rim of the rear wheel 9. Then, the shaft 91 of the rear wheel 9 is detached from the two support shafts 23 and 24 of the first support rack 2 of the support base 1. Then, the two screw members 22 are unscrewed, so that the second support rack 3 is pivoted relative to the first support rack 2, thereby folding the damping device of the exercising cycle as shown in FIG. 12. Thus, the folded damping device of the exercising cycle has a smaller volume, thereby facilitating storage and transportation thereof.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A damping device for an exercising cycle, comprising a support base, and a damping unit, wherein:

the damping unit is mounted on the support base and includes a contact wheel rotatably mounted on the support base and having a shaft, a flywheel mounted on a first end of the shaft of the contact wheel, and a stirring wheel mounted on a second end of the shaft of the contact wheel and mounted in a container which contains hydraulic oil therein;

the flywheel includes a plurality of arcuate blades;

the stirring wheel includes a plurality of arcuate blade;

the support base is provided with two spaced support ears, and the damping unit further includes a support member pivotally mounted on the two support ears of the support base, and a retaining member mounted on a top end of the support member, wherein the support member and the retaining member form a substantially L-shaped configuration, and the contact wheel is mounted on the support member;

the damping unit further includes a threaded rod extended through and rotatably mounted on the retaining member and having a first end provided with a holding portion and a second end rotatably and securely rested on a surface of the support base.

2. The damping device for an exercising cycle in accordance with claim 1, wherein the surface of the support base is formed with a concave portion for receiving the second end of the threaded rod.

3. The damping device for an exercising cycle in accordance with claim 1, wherein the damping unit includes a positioning nut movably mounted on the threaded rod and fixedly mounted on the retaining member for moving the retaining member.

4. The damping device for an exercising cycle in accordance with claim 1, wherein the support base includes a substantially U-shaped first support rack, and a substantially U-shaped second support rack foldably combined with the first support rack.

5. The damping device for an exercising cycle in accordance with claim 4, wherein the first support rack is provided with two protruding ears for foldably mounting the second support rack by two screw members.

6. The damping device for an exercising cycle in accordance with claim 4, wherein the first support rack of the support base has two distal ends formed with two support shafts for mounting a rear wheel.

7. The damping device for an exercising cycle in accordance with claim 4, wherein the container is mounted on the mediate portion of the first support rack of the support base.

* * * * *